US007066675B1

(12) United States Patent
Miller

(10) Patent No.: US 7,066,675 B1
(45) Date of Patent: Jun. 27, 2006

(54) NAIL-POLISH REMOVING APPARATUS

(76) Inventor: Teresa Miller, 5407 Kidwell Ct., Indianapolis, IN (US) 46239

( * ) Notice: Subject to any disclaimer, the term of this patent is extended or adjusted under 35 U.S.C. 154(b) by 17 days.

(21) Appl. No.: 10/985,682

(22) Filed: Nov. 12, 2004

(51) Int. Cl.
*A46B 11/00* (2006.01)

(52) U.S. Cl. ..... 401/126; 401/127; 401/130; 401/18

(58) Field of Classification Search ..... 401/123, 401/130, 125–127, 129, 18
See application file for complete search history.

(56) References Cited

U.S. PATENT DOCUMENTS

| | | | | |
|---|---|---|---|---|
| 988,544 | A * | 4/1911 | Bradford | 401/127 |
| 1,607,702 | A * | 11/1926 | Siline et al. | 401/127 |
| 2,168,179 | A * | 8/1939 | Tobey | 401/126 |
| 2,627,619 | A | 2/1953 | Gagen | |
| D203,658 | S | 2/1966 | Schoenfield et al. | |
| 4,407,311 | A * | 10/1983 | Gueret | 401/130 |
| 4,440,181 | A | 4/1984 | Scherer | |
| 4,733,788 | A | 3/1988 | D'Amico | |
| 5,201,809 | A * | 4/1993 | Miura | 401/129 |
| 5,620,270 | A * | 4/1997 | Gueret | 401/126 |
| 5,826,741 | A | 10/1998 | Dumler et al. | |
| 6,045,280 | A | 4/2000 | Nadel et al. | |
| D429,154 | S | 8/2000 | Chang | |
| 6,120,202 | A | 9/2000 | Donsky | |
| 6,213,660 | B1 | 4/2001 | Waller et al. | |
| 2005/0232681 | A1* | 10/2005 | Gueret | 401/126 |
| 2005/0249539 | A1* | 11/2005 | Habatjou | 401/127 |

* cited by examiner

*Primary Examiner*—Khoa D. Huynh

(57) ABSTRACT

A nail polish removing apparatus includes a container including an outer wall and an open top edge portion having a threaded outer surface. A first lid includes a centrally disposed threaded lip portion and a recessed portion aligned with the lip portion. The apparatus further includes a second lid, attachable to the lip portion, and provided with an annular opening. An elongated wand having opposed end portions and a cleansing head is also included. The slot and the opening are such that the cleansing head can be positioned through the slot but not the opening. The wand has a lower portion smaller than the opening so that the second lid can be detached from the first lid without causing the wand to rotate. The cavity is larger than the cleansing head such that an entire length of the cleansing head can be maintained within the cavity.

18 Claims, 3 Drawing Sheets

NAIL-POLISH REMOVING APPARATUS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to personal hygiene products and, more particularly, to a nail-polish removing apparatus for assisting a user to selectively remove nail polish from a first surface while reducing the likelihood of spilling excess nail polish on a second surface.

2. Prior Art

Applicator bottles used for applying nail polish remover to finger and/or toe nails have long been known. These bottles include a single nail polish remover-filled internal chamber having a single cap engaged with a single applicator, with the applicator placed in the chamber.

The nail polish removal kits known in the prior art have design deficiencies. For example, the closure systems leak so that the nail polish removal solvents tend to evaporate. This results in unnecessary and relatively rapid evaporation of the contents from the kit so that the useful life of the kit is unnecessarily and prematurely shortened. The containers utilized by the kits tend to be designed so that their contents spill easily. This is especially true of the straight sided containers.

Other design defects include using container wall materials through which the nail polish removal solvent could evaporate at an unacceptable rate, the use of foam inside the containers in an excessively loose manner, and the lack of means for removing polish from toenails as well as from the fingers. When using a bottle of nail-polish remover it may be necessary to use a brush that has a smaller diameter than the brush provided for fine corrections. This is especially necessary when removing nail-polish from areas where the nail and the finger are adjacent to each other.

Accordingly, a need remains for a nail-polish removing apparatus in order to overcome the above-noted shortcomings. The present invention satisfies such a need by providing an apparatus that is easy to use, time and cost-effective, convenient, light weight and novel in design. Such a nail-polish removing apparatus provides users with a faster, cleaner and easier method of removing from fingernails and toenails. The apparatus advantageously allows nail polish to be removed from toenails without disturbing or smudging nail polish on fingernails, and vice-versa. Such an apparatus saves women a considerable amount of time energy while removing nail polish and is appreciable by do-it-yourself, as well as, professional nail technicians.

BRIEF SUMMARY OF THE INVENTION

In view of the foregoing background, it is therefore an object of the present invention to provide a nail-polish removing apparatus. These and other objects, features, and advantages of the invention are provided by an apparatus for assisting a user to selectively remove nail polish from a first surface while advantageously reducing the likelihood of spilling excess nail polish on a second surface.

The apparatus includes a container for conveniently housing a predetermined quantity of nail polish removing liquid and has a centrally disposed longitudinal axis. Such a container includes a substantially smooth outer wall for being grasped by the user. The container further includes an open top edge portion equidistantly spaced inwardly from the outer wall and centered about the axis. Such a top edge portion has a threaded outer surface.

A first lid is removably attachable to the top edge portion and includes a centrally disposed lip portion centered about the axis and protruding upwardly from the first lid. Such a lip portion has a threaded outer surface and is integral with the outer wall. The first lid further includes a recessed portion vertically aligned with the lip portion and extending downwardly therefrom such that a cavity is formed therebetween. Such a recessed portion is provided with a rectangular slot situated above a fill line of the container.

A second lid is removably attachable to the lip portion and is provided with an annular opening vertically aligned with the slot for defining a free and unobstructed passageway extending along the axis from a bottom surface of the container to an exterior of the lip portion. The first and second lids are independently operable such that the second lid can be removed from the lip portion while the first lid is maintained at a stationary position. The first lid further preferably has a diameter greater than a diameter of the second lid.

The present invention further includes an elongated wand having a substantially linear shape and opposed end portions positionable within the container and exterior of the second lid respectively such that a user can repeatedly remove the wand from the container while the first lid is engaged with the container.

Such a wand further includes a cleansing head connected to one of the end portions thereof. The slot and opening are sized and shaped such that the cleansing head can advantageously be positioned through the slot but not the opening to thereby allow a user to maintain the cleansing head spaced within the cavity while excess nail polish is conveniently removed from the cleansing head. The cleansing head preferably includes a plurality of bristles having the same length. Such a cleansing head may include an outer surface converging downwardly and medially for defining a tip portion. The cleansing head may alternately include an outer surface having oppositely spaced sidewalls wherein one of the sidewalls extends parallel to a longitudinal length of the wand and another of the sidewalls thereof converges downwardly towards the one sidewall.

The wand has a lower portion sized and shaped smaller than the opening so that the second lid can be rotatably detached from the first lid without causing the wand to rotate. The cavity is sized and shaped larger than the cleansing head such that an entire length of the cleansing head can effectively be maintained within the cavity as needed.

The wand preferably further includes an upper portion sized and shaped larger than the opening such that the wand is conveniently supportable at an elevated position when the second lid is removed from the first lid. The lower portion of the wand is sized and shaped for effectively fitting through the slot and not the opening and the upper portion is sized and shaped for not passing through the opening.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
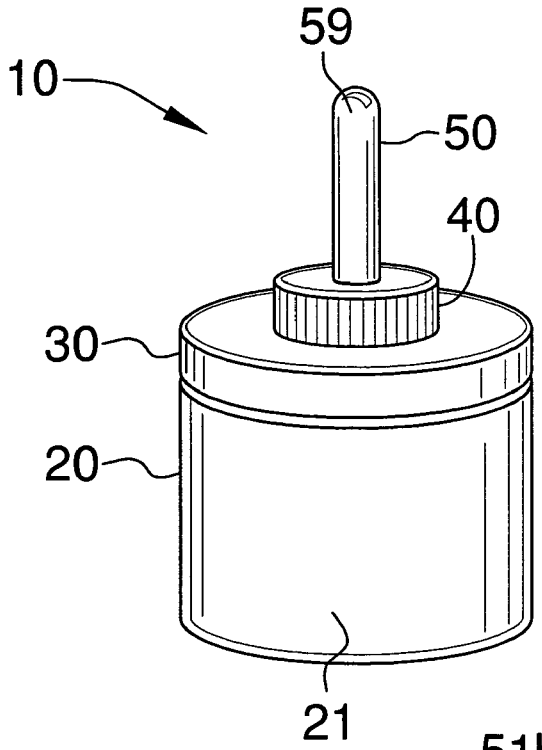
FIG. 1 is a perspective view showing a nail-polish removing apparatus, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–5 by the reference numeral 10 and is intended to provide a nail-polish removing apparatus. It should be understood that the apparatus 10 may be used to remove nail polish from many different types of surfaces and should not be limited to only fingernail polish removal.

Referring initially to FIG. 1, the apparatus 10 includes a container 20 for conveniently housing a predetermined quantity of nail polish removing liquid 11 and has a centrally disposed longitudinal axis. Such a container 20 includes a substantially smooth outer wall 21 for being easily and firmly grasped by the user. The container 20 further includes an open top edge portion 22 equidistantly spaced inward from the outer wall 21 and centered about the axis. Such a top edge portion 22 has a threaded outer surface 23.

Figure 2:
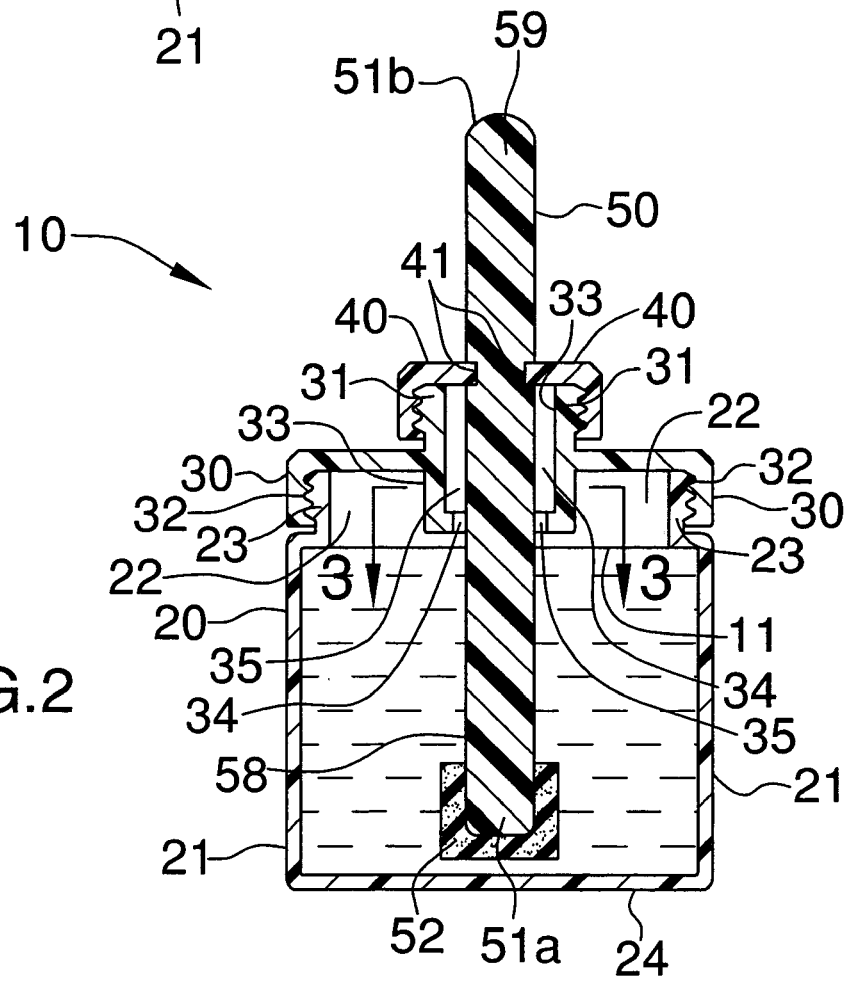
FIG. 2 is a cross-sectional view of the apparatus shown in FIG. 1, showing the first and second lid, and the wand positioned within the container.
Figure 3:
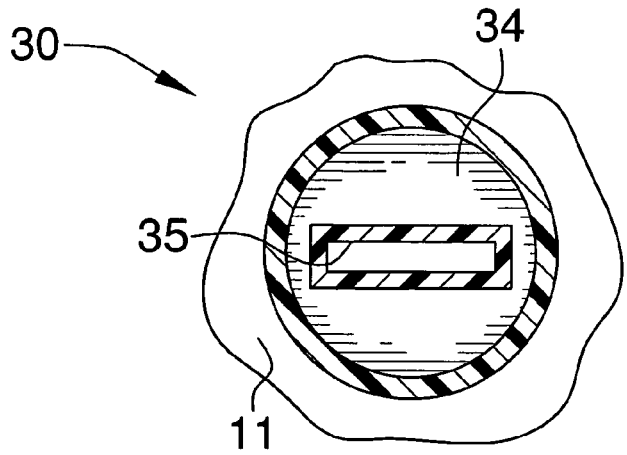
FIG. 3 is a cross-sectional view of the first lid shown in FIG. 2, taken along line 3—3.

Referring to FIGS. 1, 2 and 3, a first lid 30 is removably attachable to the top edge portion 22 and includes a centrally disposed lip portion 31 centered about the axis and protruding upwardly from the first lid 30. Such a lip portion 31 has a threaded outer surface 32 and is integral with the outer wall 21. The first lid 30 further includes a recessed portion 33 vertically aligned with the lip portion 31 such that the inner wall of the recessed portion is flush with the inner wall of the lip portion, and the recessed portion extending downwardly therefrom such that a cavity 34 is formed therebetween. Such a recessed portion 33 is provided with a rectangular slot 35 situated above a fill line of the container 20, such that the nail polish remover advantageously does not enter the cavity 34.

Figure 4:
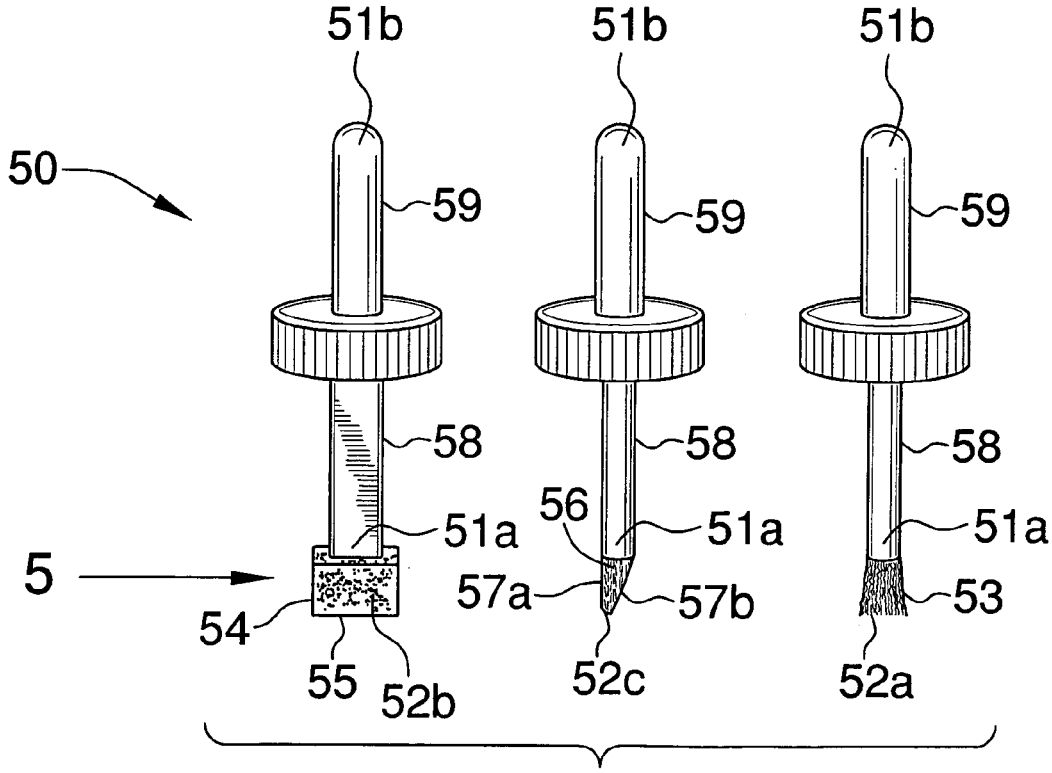
FIG. 4 is a perspective view showing alternate embodiments of the wand cleansing heads.

Referring to FIGS. 1, 2 and 4, a second lid 40 is removably attachable to the lip portion 31 and is provided with an annular opening 41 vertically aligned with the slot 35 for defining a free and unobstructed passageway extending along the axis from a bottom surface 24 of the container 20 to an exterior of the lip portion 31. The first 30 and second 40 lids are independently operable such that the second lid 40 can be removed from the lip portion 31 while the first lid 30 is maintained at a stationary position. The first lid 30 further has a diameter greater than a diameter of the second lid 40. Advantageously a virtually air tight seal is formed between the outer wall 21 and the first lid 30, and also between the first lid 30 and the second lid 40, such that the nail polish remover within the container 20 does not readily evaporate.

Referring to FIGS. 1, 2, 4 and 5, the present invention further includes an elongated wand 50 having a substantially linear shape and opposed end portions 51A/B positionable within the container 20 and exterior of the second lid 40 respectively such that a user can repeatedly remove the wand 50 from the container 20 while the first lid 30 is engaged with the container 20.

Figure 5:
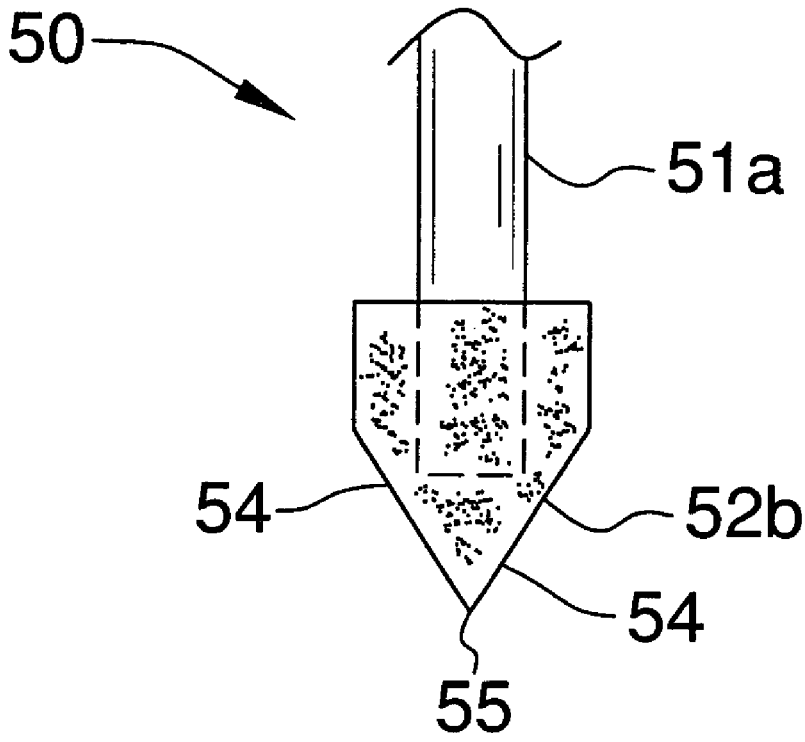
FIG. 5 is a side elevational view showing a preferred embodiment of the cleansing head.

Referring to FIGS. 2, 4 and 5, such a wand 50 includes a cleansing head 52 connected to one of the end portions 51A thereof. The slot 35 and opening 41 are sized and shaped such that the cleansing head 52 can advantageously be positioned through the slot 35 but not the opening 41 to thereby allow a user to maintain the cleansing head 52 spaced within the cavity 34 while excess nail polish is conveniently removed from the cleansing head 52. This conveniently prevents such excess nail polish from dripping onto the user's hand, clothes or other undesired surface.

The cleansing head 52A includes a plurality of bristles 53 having the same length. The cleansing head 52B may also include an outer surface 54 converging downwardly and medially for defining a tip portion 55 or the cleansing head 52C may further include an outer surface 56 having oppositely spaced sidewalls 57 wherein one of the sidewalls 57A extends parallel to a longitudinal length of the wand 50 and the other sidewall 57B thereof converges downwardly towards the one sidewall 57A.

Referring to FIG. 2, the wand 50 has a lower portion 58 sized and shaped smaller than the opening 41 so that the second lid 40 can be rotatably detached from the first lid 30 without causing the wand 50 to rotate. The cavity 34 is sized and shaped larger than the cleansing head 52 such that an entire length of the cleansing head 52 can effectively be maintained within the cavity 34 as needed. This advantageously ensures that the cleansing head is uniformly covered with nail polish remover, allowing for a more complete and less time consuming cleaning process.

Referring to FIGS. 1, 2 and 4, the wand 50 further includes an upper portion 59 sized and shaped larger than the opening 41 such that the wand 50 is conveniently supportable at an elevated position when the second lid 40 is removed from the first lid 30. The lower portion 58 of the wand is sized and shaped for effectively fitting through the slot 35 and not the opening 41 and the upper portion 59 is sized and shaped for not passing through the opening 41.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An apparatus for assisting a user to selectively remove nail polish from a first surface while reducing the likelihood of spilling excess nail polish on a second surface, said apparatus comprising:

a container for housing a predetermined quantity of nail polish removing liquid and having a centrally disposed longitudinal axis, said container including a substantially smooth outer wall for being grasped by the user, said container further including an open top edge portion equidistantly spaced inward from said outer wall and centered about the axis, said top edge portion having a threaded outer surface;

a first lid removably attachable to said top edge portion and including a centrally disposed lip portion centered about the axis and protruding upwardly from said first lid, said lip portion having a threaded outer surface and being integral with said outer wall, said first lid further including a recessed portion vertical aligned with said lip portion such that the inner wall of said recessed portion is flush with the inner wall of said lip portion, the recessed portion extending downwardly therefrom such that a cavity is formed therebetween, said recessed portion being provided with a rectangular slot;

a second lid removably attachable to said lip portion and being provided with an annular opening vertically aligned with the slot for defining a free and unobstructed passageway extending along the axis from a bottom surface of said container to an exterior of said lip portion, said first and second lids being independently operable such that said second lid is removed from said lip portion while said first lid is maintained at a stationary and engaging position with said container; and an elongated wand having a substantially linear shape and further having opposed end portions, one of said end portions is positioned within said container and the opposite end portion is extended through said second lid to the exterior of said second lid such that the user is able to repeatedly remove said wand from said container while said first lid is engaged with said container, said wand further including a cleansing head connected to one said end portions thereof;

wherein said slot and said opening are sized and shaped such that said cleansing head is positioned through the slot but not the opening to thereby allow a user to maintain said cleansing head spaced within the cavity while excess nail polish is removed from said cleansing head, said wand having a lower portion sized and shaped smaller than the opening so that said second lid is rotatably detached from said first lid without causing said wand to rotate.

2. The apparatus of claim 1, wherein said first lid has a diameter greater than a diameter of said second lid.

3. The apparatus of claim 1, wherein said cleansing head comprising: a plurality of bristles having the same length.

4. The apparatus of claim 1, wherein said cleansing head comprises: an outer surface converging downwardly and medially for defining a tip portion.

5. The apparatus of claim 1, wherein said wand further includes an upper portion having sized and shaped larger than the opening such that said wand is supportable at an elevated position when said second lid is removed from said first lid, said lower portion of said wand being sized and shaped for fitting through the slot and not the opening, said upper portion being sized and shaped for not passing through the opening.

6. The apparatus of claim 1, wherein said cleansing head comprises: an outer surface having oppositely spaced sidewalls wherein one said sidewalls extends parallel to a longitudinal length of said wand and another said sidewalls thereof converges downwardly towards said one sidewall.

7. An apparatus for assisting a user to selectively remove nail polish from a first surface while reducing the likelihood of spilling excess nail polish on a second surface, said apparatus comprising:

a container for housing a predetermined quantity of nail polish removing liquid and having a centrally disposed longitudinal axis, said container including a substantially smooth outer wall for being grasped by the user, said container further including an open top edge portion equidistantly spaced inward from said outer wall and centered about the axis, said top edge portion having a threaded outer surface;

a first lid removably attachable to said top edge portion and including a centrally disposed lip portion centered about the axis and protruding upwardly from said first lid, said lip portion having a threaded outer surface and being integral with said outer wall, said first lid further including a recessed portion vertical aligned with said lip portion such that the inner wall of said recessed portion is flush with the inner wall of said lip portion, the recessed portion extending downwardly therefrom such that a cavity is formed therebetween, said recessed portion being provided with a rectangular slot situated above a fill line of said container;

a second lid removably attachable to said lip portion and being provided with an annular opening vertically aligned with the slot for defining a free and unobstructed passageway extending along the axis from a bottom surface of said container to an exterior of said lip portion, said first and second lids being independently operable such that said second lid is removed from said lip portion while said first lid is maintained at a stationary and engaging position with said container; and an elongated wand having a substantially linear shape and further having opposed end portions, one of said end portions is positioned within said container and the opposite end portion is extended through said second lid to the exterior of said second lid such that the user is able to repeatedly remove said wand from said container while said first lid is engaged with said container, said wand further including a cleansing head connected to one said end portions thereof;

wherein said slot and said opening are sized and shaped such that said cleansing head is positioned through the slot but not the opening to thereby allow a user to maintain said cleansing head spaced within the cavity while excess nail polish is removed from said cleansing head, said wand having a lower portion sized and shaped smaller than the opening so that said second lid is rotatably detached from said first lid without causing said wand to rotate.

8. The apparatus of claim 7, wherein said first lid has a diameter greater than a diameter of said second lid.

9. The apparatus of claim 7, wherein said cleansing head comprising: a plurality of bristles having the same length.

10. The apparatus of claim 7, wherein said cleansing head comprises: an outer surface converging downwardly and medially for defining a tip portion.

11. The apparatus of claim 7, wherein said wand further includes an upper portion having sized and shaped larger than the opening such that said wand is supportable at an elevated position when said second lid is removed from said first lid, said lower portion of said wand being sized and shaped for fitting through the slot and not the opening, said upper portion being sized and shaped for not passing through the opening.

12. The apparatus of claim 7, wherein said cleansing head comprises: an outer surface having oppositely spaced sidewalls wherein one said sidewalls extends parallel to a longitudinal length of said wand and another said sidewalls thereof converges downwardly towards said one sidewall.

13. An apparatus for assisting a user to selectively remove nail polish from a first surface while reducing the likelihood of spilling excess nail polish on a second surface, said apparatus comprising:

a container for housing a predetermined quantity of nail polish removing liquid and having a centrally disposed longitudinal axis, said container including a substantially smooth outer wall for being grasped by the user, said container further including an open top edge portion equidistantly spaced inward from said outer wall and centered about the axis, said top edge portion having a threaded outer surface;

a first lid removably attachable to said top edge portion and including a centrally disposed lip portion centered about the axis and protruding upwardly from said first lid, said lip portion having a threaded outer surface and being integral with said outer wall, said first lid further including a recessed portion vertical aligned with said lip portion such that the inner wall of said recessed portion is flush with the inner wall of said lip portion, the recessed portion extending downwardly therefrom such that a cavity is formed therebetween, said recessed portion being provided with a rectangular slot situated above a fill line of said container;

a second lid removably attachable to said lip portion and being provided with an annular opening vertically aligned with the slot for defining a free and unobstructed passageway extending along the axis from a bottom surface of said container to an exterior of said lip portion, said first and second lids being independently operable such that said second lid is removed from said lip portion while said first lid is maintained at a stationary and engaging position with said container; and an elongated wand having a substantially linear shape and further having opposed end portions one of said end portions is positioned within said container and the opposite end portion is extended through said second lid to the exterior of said second lid such that the user is able to repeatedly remove said wand from said container while said first lid is engaged with said container, said wand further including a cleansing head connected to one said end portions thereof;

wherein said slot and said opening are sized and shaped such that said cleansing head is positioned through the slot but not the opening to thereby allow a user to maintain said cleansing head spaced within the cavity while excess nail polish is removed from said cleansing head, said wand having a lower portion sized and shaped smaller than the opening so that said second lid is rotatably detached from said first lid without causing said wand to rotate, the cavity being sized and shaped larger than said cleansing head such that an entire length of said cleansing head is maintained within the cavity as needed.

14. The apparatus of claim 13, wherein said first lid has a diameter greater than a diameter of said second lid.

15. The apparatus of claim 13, wherein said cleansing head comprising: a plurality of bristles having the same length.

16. The apparatus of claim 13, wherein said cleansing head comprises: an outer surface converging downwardly and medially for defining a tip portion.

17. The apparatus of claim 13, wherein said wand further includes an upper portion having sized and shaped larger than the opening such that said wand is supportable at an elevated position when said second lid is removed from said first lid, said lower portion of said wand being sized and shaped for fitting through the slot and not the opening, said upper portion being sized and shaped for not passing through the opening.

18. The apparatus of claim 13, wherein said cleansing head comprises: an outer surface having oppositely spaced sidewalls wherein one said sidewalls extends parallel to a longitudinal length of said wand and another said sidewalls thereof converges downwardly towards said one sidewall.

* * * * *